United States Patent [19]

Greenwood

[11] Patent Number: 4,947,489

[45] Date of Patent: Aug. 14, 1990

[54] GARMENT SUPPORT

[76] Inventor: Penny R. Greenwood, 4142 Downers Dr., Downers Grove, Ill. 60515

[21] Appl. No.: 321,789

[22] Filed: Mar. 10, 1989

[51] Int. Cl.[5] ..... A41F 5/00

[52] U.S. Cl. ..... 2/304; 2/271; 2/217; 2/101; 2/338; 2/80; 2/300; 604/385.1

[58] Field of Search ..... 2/80, 101, 217, 229, 2/230, 271, 304, 305, 324, 325, 326, 338, 342; 604/393, 385.1; 450/106, 110, 111

[56] References Cited

U.S. PATENT DOCUMENTS

| | | | |
|---|---|---|---|
| 863,970 | 8/1907 | Ebersole | 2/326 |
| 1,280,184 | 10/1918 | Dow | 2/70 X |
| 1,309,765 | 7/1919 | Meyer | 2/338 |
| 1,310,271 | 7/1919 | Achtmeyer | 2/338 |
| 2,028,602 | 1/1936 | Hanson | 604/393 X |
| 2,608,691 | 9/1952 | Berg | 2/325 |
| 3,418,659 | 12/1968 | Brown | 2/70 |

FOREIGN PATENT DOCUMENTS

| | | | |
|---|---|---|---|
| 1504794 | 12/1967 | France | 2/111 |

*Primary Examiner*—Werner H. Schroeder
*Assistant Examiner*—Jeanette E. Chapman
*Attorney, Agent, or Firm*—Hill, Van Santen, Steadman & Simpson

[57] ABSTRACT

A shirt-type garment, for example for an infant, has first and second female fasteners mounted thereto spaced apart on the side of the garment above the lower edge and a third female fastener located, generally centrally, on a center line above and between the first and second female fasteners. A T-shaped element has a strip carrying fourth and fifth male fasteners for detachable engagement with the first and second fasteners, and a stem depending therefrom constructed of an adjustable elastic strip which carries a sixth male fastener at its distal end. The elastic strip extends through the leg opening of the diaper worn by the person, is folded back upon itself, and the sixth male fastener is detachably engaged with the third female fastener for urging the garment and the diaper towards one another.

14 Claims, 1 Drawing Sheet

FIG. 1
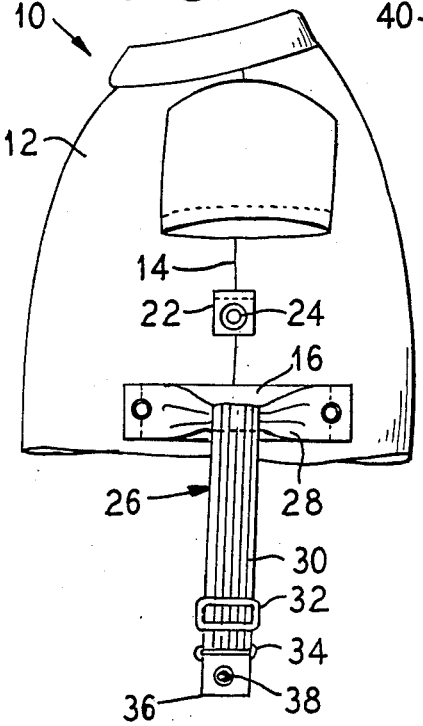
FIG. 3
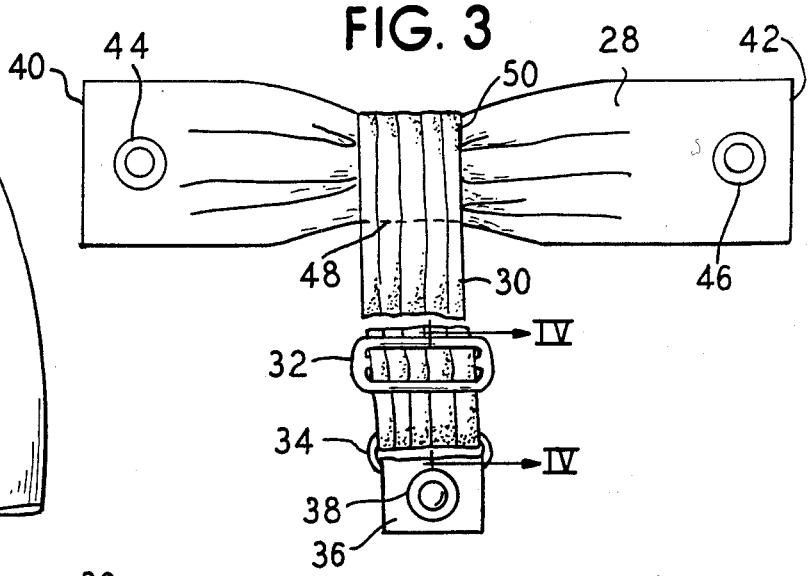
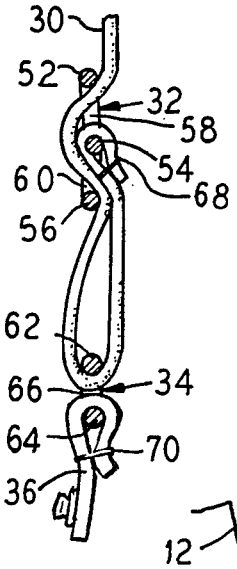
FIG. 2
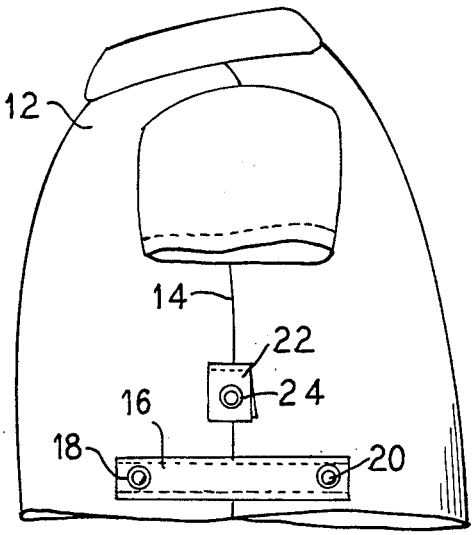
FIG. 5
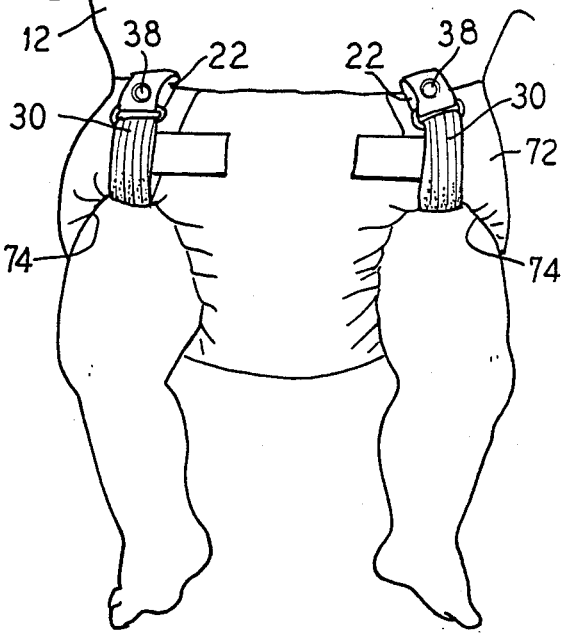

GARMENT SUPPORT

BACKGROUND OF THE INVENTION

1. Field of the Invention:

The present invention relates to a garment support, and more particularly to a garment support for infants and young children who wear diapers.

2. Description of the Prior Art

Although a device constructed in accordance with the present invention is primarily for keeping a child's shirt pulled down and prevent the shirt from creeping up over the abdomen, other uses will be apparent from the description below. When young children are being lifted up or held by an adult their shirts tend to raise up to expose their abdomen to the environment. This is also a problem for toddlers and children old enough to walk and play, but who still wear diapers.

It is well known in the art to provide stocking supports in the form of a garter belt encircling the waist or a garter belt encircling the leg above the calf, with a plurality of depending, usually elastic, strips for attachment to the upper portions of stockings.

It is also well known in the art to secure a diaper to an upper garment, such as an undershirt, by pins or the like.

In U.S. No. 1,753,125 Max Lederman discloses a support structure having a garter worn about the upper part of a leg, with depending strips for attachment to a stocking and upwardly-extending strips for attachment to a garment such as the bottom of a shirt.

SUMMARY OF THE INVENTION

It is an object of the invention to protect the abdomen of a child from exposure.

When using disposable diapers it is common for the waist of the diaper to fold under and for the paper edges to rub against the abdomen of a child. It is therefore an object of the invention to protect the child's sensitive skin on his abdomen from scratchy diaper edges. This object is achieved when a support constructed in accordance with the present invention is used in that the fabric of the garment protects the skin from direct contact with the paper edges of the disposable diaper.

Another object of the invention is to protect a child's upper thighs from stiff diaper tape edges. Disposable diapers are applied to a child so that there is some overlap from the back to the front of the diaper. However, the overlap thins as the diaper is worn so that in a very short time the edge of the tape which secures the diaper onto the child is directly against the upper thigh, frequently digging in and causing irritation. A support constructed in accordance with the present invention pads and guards the skin against direct contact with the tape edges of the disposable diaper.

Another object of the invention is to extend the life of a garment of a child which has grown taller. A shirt that is tucked in does not need to be as long as one that is worn outside of a diaper. A support constructed in accordance with the present invention is adjustable so that the shirt is held down just a short distance under the diaper edge at the waist. This prevents the shirt from becoming wet like the diaper and also permits the length of the shirt to be shorter while still providing comfort and protection for the abdomen, as well as an attractive appearance.

Another object of the invention is to provide additional styling and design to children's clothing. The support may be constructed in white so as to go unnoticed by blending in with white diapers and/or to be constructed of various colors and patterns that coordinate the child's garment, such as a man's suspenders coordinate with his shirt or pants.

Another object of the invention is to improve the general appearance and comfort of an infant. Active infants and children quickly find their shirts to have creeped up over their abdomens. Bunched clothing generally feels tight and itchy. A tuck-in, pulled down shirt is more secure and feels more comfortable.

Another object of the invention is to provide a garment support for infants and children who wear diapers, such that the garment support can be purchased with a shirt as an outfit and is thus coordinated in color with a tape already applied to the shirt and provided ready for use.

Another object of the invention is to provide a garment support for infants and children who wear diapers such that the garment support can be purchased separately, i.e. as a kit, and easily applied to existing clothing to convert the clothing into more useful and comfortable garments.

Another object of the invention is to provide a garment support for older persons who have an incontinence problem, particularly those who may wear undergarments and diapers beneath outer wear, such as clothing, pajamas or hospital type gowns. Supports constructed in accordance with the present invention will also provide the above advantages, particularly with respect to comfort.

BRIEF DESCRIPTION OF THE DRAWING

Other objects, features and advantages of the invention will be best understood from the following description, taken in conjunction with the accompanying drawing, on which:

FIG. 1 is a side view of a support constructed in accordance with the present invention and as attached to a shirt-type child's garment;

FIG. 2 is a side view, similar to that of FIG. 1, showing elements for attachment of the support to the garment;

FIG. 3 is an enlarged view of a detachable portion of a support constructed in accordance with the present invention;

FIG. 4 is a sectional view taken substantially along the line IV—IV of FIG. 3; and FIG. 5 is a front view of the lower portion of an infant wearing an upper garment and a diaper and showing the application of a pair of garment supports constructed in accordance with the present invention.

DESCRIPTION OF THE PREFERRED EMBODIMENTS

As used herein "up" and "down", and derivitives thereof generally refer to the directions of the head and the feet respectively, of an infant, child or person. Also, although the invention may find use with respect to older persons, the same will be directed to infants and children in the description below.

Referring to FIGS. 1 and 2, the support of the invention is generally illustrated at 10 in connection with an upper garment 12 including a side having a center line 14 which may be seam or an imaginary line generally centered between the front and the back of the garment 12. As best seen in FIG. 2, a strip 16 carries first and second snap fasteners 18 and 20 adjacent respective ends thereof and is sown to the fabric of the garment 12. The strip 16 is preferably constructed of a material which resists stretching parallel and perpendicular to its length. The strip 16 is folded under to a length of approximately 4½" and the fasteners 18 and 20 are applied before the strip is sown to the garment. Here, the fasteners 18 and 20 are female fasteners.

The strip 16 is sown to the garment 12 so that the strip is positioned 2" posterior to the line 14 and 2½" anterior to the line 14. As is evident, the fabric of the garment protects the skin of the child from direct contact with the faces of the fasteners and also defines a relatively non-stretchable section of the garment to ensure that forces applied to the body of the garment will act directly upon the fasteners. Although snap fasteners can be applied directly to knits, the stretchability of the fabric allows the fasteners to become loose and may even permit tears to the body of the fabric. The strip 16 therefore also solves the problem of stretchability between the fasteners.

A fabric tab 22 of approximately ¾" length is constructed of material either similar or identical to that of the material of the strip 16 and is sown at its upper edge to the garment 12 after a third snap fastener 24, here again a female fastener is secured thereto.

Attention is now directed to FIGS. 1, 3 and 4 which better illustrate a further element 26 of the support in greater detail. The element 26 comprises a strip of material 28, again a strip of woven tape or other fabric which resist stretching parallel and perpendicular to its length. Depending from the strip 28 is a flexible strip 30 which is adjustable in length by way of a slide 32 and which is connected by way of a link 34 to a fabric tab 36 which is, here again, constructed of a material similar to or identical to the material of the strip 28.

As is evident from FIGS. 1 and 3, the strip 28 and the strip 30 form a generally T-shaped element in which the strip 28 is the cross member of the T and the strip 30 is the stem of the T.

The cross member 28 of the T is, as mentioned, is constructed of a strip of woven fabric or other material which resists stretching parallel and perpendicular to its length. The strip 28 may be approximately ¾" wide and approximately 8" long which is then seamed and sown on the edges so that only the outer portion of the fabric is visible. The finished length of the member 28 is approximately 4" in length. The member 28 has a pair of ends 40 and 42 and carries fourth and fifth fasteners 44, 46 adjacent respective ones of the ends 40, 42. Here, the fasteners are male fasteners.

The stem 30 of the T may be constructed of a ¾" wide soft, preferably stretch elastic, material cut 5" in length. The top portion of the strip 30 is folded over and sown to itself, as at 48, to form a casement of approximately ½" for receiving the member 28 therethrough in a sliding and gripping manner.

The adjustment of the length of the strip 30 is provided by way of a slide 32 and a link 34. The slide 32 comprises a plurality of cross members 52, 54 and 56 which define the upper and lower edges of a pair of slots 58 and 60. The link 34 comprises a cross member 62 and a cross member 64 which define the upper and lower edges of a slot 66. As best shown in FIG. 4, the as-yet free end of the strip 30 is directed through the slot 58, over the member 54 and through the slot 60, looped through the slot 66 and then directed back through the slot 60 and the slot 58 before being folded over the cross member 54 and sown to itself as at 68.

The upper end of the tab 36 extends through the slot 66, is folded about the cross member 64 and sown to itself as at 70. Here, a sixth male snap fastener 38 is also employed, but faces opposite to that of the male fasteners 44, 46 as will be evident from the description below.

Referring to FIG. 5, a pair of supports, constructed in accordance with the present invention, are illustrated in connection with a garment 12 and a diaper 72 which has a leg opening 74. As can be seen, the elongate elastic elements 30 extend beneath the upper portion of the diaper, through the leg openings 74 and are folded back upon themselves so that the fasteners 38 engage the respective fasteners 24 carried by the respective tabs 22.

As mentioned above, the support or supports may be provided with the garment or may be provided in kit form for use with different garments. Also, other easily-detachable fasteners may be used in place of the snap fasteners. For example, garter grip fasteners or Velcro® type fasteners may be employed, as provided by the American Velcro Corporation.

Many other changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A support for a shirt-type garment worn by a person and having a garment side, a central line of the side, and a lower edge, in combination with a diaper having a leg opening for a leg of the person and an upper edge spaced from said leg opening, said combination comprising:

a first fastener mounted to said side, spaced from said lower edge and spaced anterior of said central line;

a second fastener mounted to said side, spaced from said lower edge and spaced posterior from said central line;

a third fastener mounted to said side between and spaced from said first and second fasteners and spaced from said lower edge a distance greater than the spacing of said first fastener from said lower edge; and a T-shaped element including a cross member and a stem depending from said cross member and including a distal end, said cross member including first and second ends, fourth and fifth fasteners respectively mounted spaced from said first and second ends and releasably engageable with said first and second fasteners, respectively, for detachably mounting said T-shaped element to said side of said garment, and a sixth fastener mounted to said distal end of said stem for releasable engagement with said third fastener, whereby said stem may be looped through said leg opening of said diaper and secure said garment to said diaper.

2. The support of claim 1, wherein:

said stem includes a proximal end in the form of a loop slidably receiving said cross member therethrough.

3. The support of claim 1, wherein:

said cross member includes a predetermined width: and said stem includes a proximal end of the form of a loop having a dimension less than said predetermined width for receivingly gripping said cross member therethrough.

4. The support of claim 1, wherein:

each of said fasteners are snap fasteners.

5. The support of claim 1, and further comprising:

adjustment means carried by said stem for adjusting the length of said stem to accommodate different sizes of children.

6. The support of claim 1, wherein:

said stem comprises a soft stretch elastic material.

7. The support of claim 1, wherein:

said stem comprises a soft stretch elastic material, and a material at said distal end identical to the material of said cross member.

8. The support of claim 1, wherein:

said cross member comprises a material which resists stretching parallel and perpendicular to its length.

9. The support of claim 8, wherein:

said distal end of said stem comprises a material identical to the material of said cross member.

10. The support of claim 1, and further comprising:

a strip mounting said first and second fasteners and said strip mounted to said side of said garment.

11. The support of claim 10, wherein:

said strip comprises a material which resists stretching parallel and perpendicular to its length.

12. The support of claim 1, and further comprising:

a tab mounting said sixth fastener to said distal end of said stem and comprising a material which resist stretching parallel and perpendicular to its length.

13. A garment support for use with a diaper worn by a person and having a leg opening receiving a leg of the person therethrough, and a shirt-type garment worn by the person, said garment support comprising:

first, second and third fasteners, and means for mounting said first, second and third fasteners to the garment;

a T-shaped element comprising a cross member and a stem depending from said cross member;

fourth and fifth fasteners carried spaced on said cross member for releasable engagement with the first and second fasteners, respectively, to detachably mount said support to the garment; and a sixth fastener carried by the distal end of said stem, whereby said stem may be looped through the leg opening and releasably fastened to the third fastener.

14. A garment support for urging a diaper, having a leg opening, towards a garment worn on the upper body of a person, comprising:

a flexible strip including first and second ends, said strip extendable through the leg opening and foldable back upon itself to define first and second overlying portions with the diaper therebetween; and attachment means including first and second fastening means secured to the garment and third and fourth fastening means carried at opposite ends of said flexible strip for detachably securing said strip to said first and second fastening means.

* * * * *